US009775220B2

(12) United States Patent
Shira

(10) Patent No.: US 9,775,220 B2
(45) Date of Patent: Sep. 26, 2017

(54) NETWORKED LIGHTING APPARATUS AND METHOD FOR SUCH LIGHTING APPARATUS TO IDENTIFY ITSELF AND COMMUNICATE ITS NETWORK ADDRESS

(71) Applicant: PHILIPS LIGHTING HOLDING B.V., Eindhoven (NL)

(72) Inventor: Rahul Shira, Chicago, IL (US)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/091,749

(22) Filed: Apr. 6, 2016

(65) Prior Publication Data

US 2016/0219681 A1 Jul. 28, 2016

Related U.S. Application Data

(62) Division of application No. 14/415,821, filed as application No. PCT/IB2013/055743 on Jul. 12, 2013, now Pat. No. 9,313,861.

(Continued)

(51) Int. Cl.
*H05B 37/00* (2006.01)
*H05B 37/02* (2006.01)

(52) U.S. Cl.
CPC ..... *H05B 37/0272* (2013.01); *H05B 37/0245* (2013.01); *H05B 37/0254* (2013.01); *H05B 37/0281* (2013.01)

(58) Field of Classification Search
CPC ..... H05B 37/029; H05B 37/0272; H05B 37/0227; H05B 37/0245; H05B 37/02;
(Continued)

(56) References Cited

U.S. PATENT DOCUMENTS 7,307,542 B1 12/2007 Chandler et al.
2002/0154025 A1 10/2002 Ling
(Continued)

FOREIGN PATENT DOCUMENTS

EP 0507381 A2 10/1992
WO 2012091561 A1 7/2012

OTHER PUBLICATIONS

Tridonic, Emergency lighting units, EM PRO EZ-3 datasheet, availalble at http://www.tridonic.com/ru/download/data_sheets/EM_PRO_EZ_3_en.pdf.

*Primary Examiner* — Monica C King
(74) *Attorney, Agent, or Firm* — Akarsh P. Belagodu

(57) ABSTRACT

In various embodiments an apparatus configured to be connected to a lighting network and to control a first and a second lighting unit in response to at least one signal received via the lighting network is disclosed. In one example, the apparatus comprises a processor configured to receive an identification command, and in response thereto to execute an algorithm for communicating a network address associated with the apparatus, the algorithm comprising sequentially, for each bit of the network address: controlling the first lighting unit, to indicate a value of the bit by the lighting unit entering a state corresponding to the value of the bit, and causing the second lighting unit, to signal that the first lighting unit validly indicates the value of the bit and causing the second lighting unit to enter a state which indicates an end of the network address.

18 Claims, 6 Drawing Sheets

Related U.S. Application Data

(60) Provisional application No. 61/673,794, filed on Jul. 20, 2012.

(58) Field of Classification Search
CPC ..... H05B 37/0218; H05B 33/0854; H05B 37/0254; H05B 37/0236; H05B 33/0863; H05B 33/0872; H05B 33/08; H05B 33/086; H05B 33/0845
See application file for complete search history.

(56) References Cited

U.S. PATENT DOCUMENTS

| | | | | |
|---|---|---|---|---|
| 2007/0014199 | A1 | 1/2007 | Park et al. | |
| 2008/0276154 | A1 | 11/2008 | Hick et al. | |
| 2016/0286629 | A1* | 9/2016 | Chen ..... | H05B 37/0272 |

* cited by examiner

NETWORKED LIGHTING APPARATUS AND METHOD FOR SUCH LIGHTING APPARATUS TO IDENTIFY ITSELF AND COMMUNICATE ITS NETWORK ADDRESS

TECHNICAL FIELD

The present invention is directed generally to lighting networks and, more specifically, to a method for an apparatus, such as a lighting ballast or lighting driver, to identify itself and communicate its network address in a lighting network to which it belongs.

BACKGROUND

In recent years, new or more stringent demands have been imposed on lighting systems, such as increased requirements for energy conservation, and the need to accommodate an increasing variety of different types of lighting units, which employ different types of light sources (e.g., incandescent, fluorescent, light emitting diode, etc.) with different driving requirements, with different types of lighting units often being deployed within a same building or even the same room. These demands have driven needs for more options and flexibility in the control of the lighting units within a facility. These needs, in turn, have led to the development and installation of lighting networks within many facilities. In particular, the lighting industry has developed the Digital Addressable Lighting Interface (DALI) standard for digital communications between the individual components of a lighting system which are connected in a lighting network.

Commissioning a lighting network installed at a site or facility generally includes preparing a map or floor plan of the site or facility which indicates the network address and physical location of each network apparatus (e.g., ballast or lighting driver) of the lighting network. The map or floor plan can then be used as a reference for any future maintenance or re-commissioning process for the lighting network. However, this commissioning process can be relatively expensive for a large lighting network, for example a large DALI network, because of the considerable number of labor hours required to prepare the map or floor plan. Traditionally, there is no easy way to determine which network apparatus at what location has been assigned what network address, because the network addresses are randomly assigned by the controller to the network apparatuses. To identify or locate a particular network apparatus at an installed facility, the commissioning engineer, installer, or end user employs a controller such as a computer which has installed thereon communication software that will send messages or commands over the lighting network. The software will list out the network addresses assigned to all of the network apparatuses in the lighting network, but it cannot determine which network apparatus is located where in the facility.

To determine the location in a facility of a network apparatus corresponding to a particular network address, the engineer, installer or end user sends a particular command to that network address, and then physically moves around in the facility to observe which network apparatus at which location responds to that command. Once this is determined, the engineer, installer or end user may then note the location of the network apparatus on the site map or layout. For example, a command may be addressed to a particular network address directing the corresponding network apparatus to dim up and down the lighting unit or units which are controlled by that network apparatus so as to cause the lights to flash. The engineer, installer or end user can then move around in the facility and observe which lights are flashing and note the location of the flashing lights and the corresponding network address on the map or floor plan. This process can be very tiresome and time consuming for the engineer/installer or the end user. To avoid the back and forth movement, two persons may work together, whereby the first person sends the command to the network address, and the second person walks around the site to determine the location of the network apparatus which responds to the command. Still, a lot of time is required for this process. However, this time could be substantially reduced if each ballast/driver could signal its network address to an engineer in response to some command to identify itself.

Thus, it would be desirable to a lighting network apparatus, which may comprise a ballast or lighting driver, which is connected to a lighting network and which can identify itself and communicate or indicate its network address to an engineer, installer or end user of the lighting network. It would further be desirable to provide a method for such an apparatus to identify itself and communicate or indicate its network address to an engineer, installer or end user of the lighting network.

SUMMARY

The present disclosure is directed to an inventive lighting network apparatus, which may comprise a ballast or lighting driver, and a method for a lighting network apparatus to identify itself and communicate its network address.

Generally, in one aspect, a method includes: receiving an identification command at an addressable apparatus which is connected to a lighting network and which is configured to control at least one lighting unit for illuminating at least a region of a facility, wherein the addressable apparatus has a network address associated therewith and has a signaling device integral thereto; sequentially, for each bit of the network address: the addressable apparatus controlling a first device among: (1) the at least one lighting unit, and (2) the signaling device, to indicate a value of the bit during a bit period by the first device entering a state corresponding to the value of the bit, and causing a second device among: (1) the at least one lighting unit, and (2) the signaling device, to signal during a time interval within the bit period that the first device validly indicates the value of the bit; and after the values for all of the bits of the network address have been indicated by the at least one lighting unit, causing at least one of the first and second devices to enter a state which indicates an end of the network address.

In one embodiment, the at least one lighting unit indicates that the value of the bit is a first value by being illuminated during the bit period, and indicates that the value of bit is a second value by not being illuminated during the bit period.

In another embodiment, the at least one lighting unit indicates that the value of the bit is a first value by being illuminated at a higher intensity during the bit period, and indicates that the value of bit is a second value by being illuminated at a lower intensity during the bit period.

According to yet another embodiment, the at least one lighting unit indicates that the value of the bit is a first value by blinking during the bit period, and indicates that the value of bit is a second value by not blinking during the bit period.

According to a still further embodiment, the signaling device is a lighting device, and the light emitting device signals by becoming illuminated during the time interval that the illumination state of the at least one lighting unit validly indicates the bit value.

According to a yet further embodiment, the signaling device is a lighting device, and the light emitting device signals by blinking during the time interval that the illumination state of the at least one lighting unit validly indicates the bit value.

According to an additional embodiment, the signaling device is a sound emitting device, and wherein the sound emitting device signals by emitting a sound during the time interval that the illumination state of the at least one lighting unit validly indicates the bit value.

Generally, in another aspect, an apparatus is configured to be connected to a lighting network and to control at least one lighting unit in response to at least one signal received via the lighting network. The apparatus includes: a signaling device integral to the apparatus; and a processor configured to receive an identification command, and in response thereto to execute an algorithm for communicating a network address associated with the apparatus. The algorithm includes: sequentially, for each bit of the network address: controlling a first device among: (1) the at least one lighting unit, and (2) the signaling device, to indicate a value of the bit during a bit period by the at first device entering a state corresponding to the value of the bit, and causing a second device among: (1) the at least one lighting unit, and (2) the signaling device, to signal during a time interval within the bit period that the first device validly indicates the value of the bit; and after the values for all of the bits of the network address have been indicated by the at least one lighting unit, causing at least one of the first and second devices to enter a state which indicates an end of the network address.

In one embodiment, the apparatus further includes an electrical circuit configured to supply power to the at least one lighting unit in response to at least one control signal supplied by the processor.

In one optional feature of this embodiment, the processor is configured to generate the at least one control signal in response to a command received via the lighting network.

According to another embodiment, the apparatus further includes a network communication interface circuit configured to communicate the identification command from the network to the processor.

According to yet another embodiment, the at least one lighting unit indicates that the value of the bit is a first value by being illuminated during the bit period, and indicates that the value of bit is a second value by not being illuminated during the bit period.

According to still another embodiment, the at least one lighting unit indicates that the value of the bit is a first value by being illuminated at a higher intensity during the bit period, and indicates that the value of bit is a second value by being illuminated at a lower intensity during the bit period.

According to a further embodiment, the at least one lighting unit indicates that the value of the bit is a first value by blinking during the bit period, and indicates that the value of bit is a second value by not blinking during the bit period.

According to a still further embodiment, the signaling device is a lighting device, and the light emitting device signals by becoming illuminated during the time interval that the illumination state of the at least one lighting unit validly indicates the bit value.

According to a yet further embodiment, the signaling device is a lighting device, and the light emitting device signals by blinking during the time interval that the illumination state of the at least one lighting unit validly indicates the bit value.

According to an additional embodiment, the signaling device is a sound emitting device, and wherein the sound emitting device signals by emitting a sound during the time interval that the illumination state of the at least one lighting unit validly indicates the bit value.

Generally, in yet another aspect, an apparatus is configured to be connected to a Digital Addressable Lighting Interface (DALI) network. The apparatus includes: a processor; a display device integral to the apparatus; and a network communication interface circuit configured to receive DALI commands via the DALI network and to provide the DALI commands to the processor. The processor causes the display device to display a DALI short address assigned to the apparatus.

In one embodiment, the network communication interface circuit is configured to receive an identification command from the DALI network and to supply the identification command to the processor, and wherein the processor causes the display device to display the DALI short address assigned to the apparatus in response to the identification command.

In one embodiment, the apparatus further includes an electrical circuit configured to supply power to at least one lighting unit in response to at least one control signal supplied by the processor.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers).

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, and other types of electroluminescent sources.

A "lighting driver" is used herein to refer to an apparatus that supplies electrical power to one or more light sources in a format to cause the light sources to emit light. In particular, a lighting driver may receive electrical power in a first format (e.g., AC Mains power; a fixed DC voltage; etc.) and supplies power in a second format that is tailored to the requirements of the light source(s) (e.g., LED light source (s)) that it drives.

The terms "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry; a lighting driver) relating to the operation of the light source(s). An "LED-based lighting unit" refers to a lighting unit that includes one or more LED-based light sources as discussed above, alone or in combination with other non LED-based light sources.

The terms "lighting fixture" and "luminaire" are used herein interchangeably to refer to an implementation or arrangement of one or more lighting units in a particular form factor, assembly, or package, and may be associated with (e.g., include, be coupled to and/or packaged together with) other components.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

As discussed above, commissioning a large lighting network, for example a large DALI network, can be relatively expensive because of the considerable number of labor hours required to generate a floor plan or map showing the locations and network addresses of all of the apparatuses of the lighting network.

Therefore, the present inventor has recognized and appreciated that it would be beneficial to provide a lighting network apparatus, which may include a ballast or lighting driver, which can communicate or indicate its address to an engineer, installer or end user in response to some command to identify itself.

In view of the foregoing, various embodiments and implementations of the present invention are directed to a network apparatus, which may include a ballast or lighting driver, for a lighting network, and a method for such a network apparatus to identify itself and communicate or indicate its network address.

Figure 1:
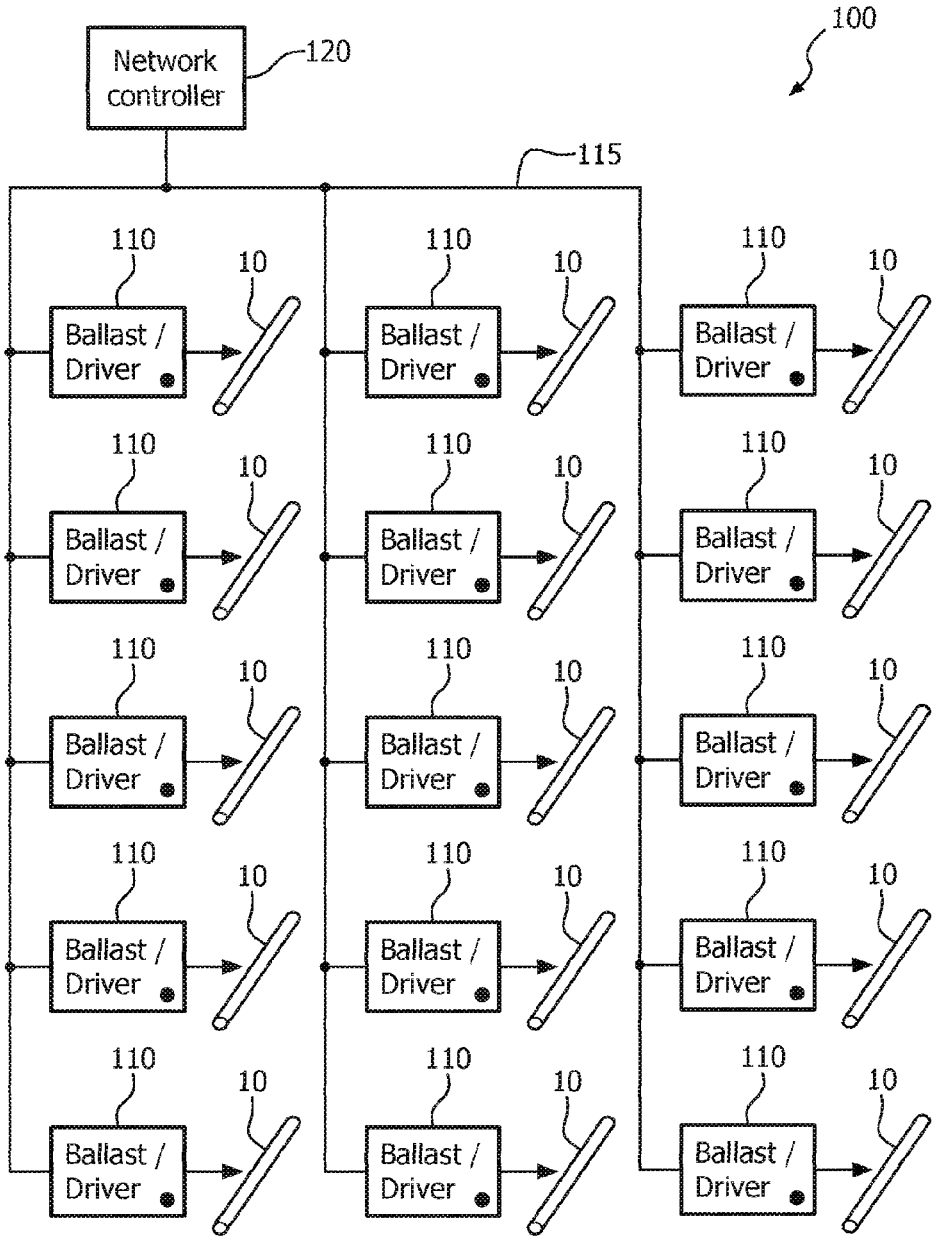
FIG. 1 illustrates an example embodiment of a lighting network.

FIG. 1 illustrates an example embodiment of a lighting network 100. Lighting network 100 includes a plurality of apparatuses 110 and at least one network controller 120 connected together via network connections 115.

In one embodiment, lighting network 100 is a Digital Addressable Lighting Interface (DALI) network. In the discussion to follow, in order to better provide a concrete illustration it is assumed that lighting network 100 is a DALI network. However, it should be understood that the principles discussed below may be applied to other types of lighting networks and in general are not limited to DALI networks, except when features that are specific to DALI networks are mentioned.

DALI is a dedicated lighting communication protocol used for the digital control of building lighting. The basic structure of this protocol is defined in the IEC 62386 standard part 1 and part 2. The DALI standard basically defines a set of two byte commands that are used to communicate to a DALI compatible device or apparatus. The commands are structured such that the first byte represents the address of the device or apparatus to which the command is directed while the second byte represents the action/command for the apparatus or device (i.e., what it is supposed to do).

Different types of apparatuses have different commands and they are defined in the different parts of the IEC 62386 standard. For example: Fluorescent lighting commands are defined in IEC 62386 part 101 and 102; emergency lighting commands are defined in IEC 62386 part 202; and LED lighting commands are defined in IEC 62386 part 207.

IEC 62386 part 202, standard for Emergency Lighting, command #240, includes a "START IDENTIFICATION" command which is not completely defined—the implementation of this command has been left to the discretion of the manufacturer. Additionally, such an identification process can be adopted by any DALI ballast/driver manufacturer by using one of the reserved commands left out in the IEC62386 102 and/or 207 standards. Thus the identification process described below is not limited to a DALI emergency ballast/driver but can also be applied to a DALI fluorescent ballast and a DALI LED driver.

Apparatuses 110 may each be configured to supply power to, and control the illumination state of, one or more lighting units 10, for example in response to one or more commands received via network connections 115 of lighting network 100. Lighting units 10 may include incandescent, fluorescent and or LED-based lighting units. Lighting units 10 may be installed in lighting fixtures, for example mounted on the ceiling, walls, and/or in display cases of a facility in which lighting network 100 is installed. Lighting apparatuses 110 may receive power, for example AC power from AC mains or DC power from a battery back-up, convert that power into an appropriate format for driving each associated lighting unit 10, and supply the properly converted power to each lighting unit 10. In one embodiment, apparatus 110 may comprise a ballast (e.g., a DALI ballast), for example a fluorescent ballast, for supplying power to one or more lighting units, for example lighting units with fluorescent light sources. In another embodiment, apparatus 110 may comprise a lighting driver (e.g., a DALI LED driver) for supplying current to one or more LED-based lighting units. In one embodiment, apparatus 110 may comprise an emergency ballast/driver (e.g., a DALI emergency ballast/driver).

Network controller 120 may be any device capable of sending commands (e.g., DALI commands) to the apparatuses 110 In a DALI network some commands may be broadcast to all apparatuses 110 which are part of lighting network 100, while other commands may be individually addressed to a specific apparatus 110 by including the network address of the specific apparatus with the command. In general a DALI command may comprise two 8-bit bytes, wherein the first byte is a so-called short address of the apparatus to which the command is being directed, and the second byte identifies the particular command to be executed. Network controller 120 may include an interface or connector (e.g., a USB connector) for connection to a computer which has software installed thereon for commissioning lighting network 100 and/or for sending commands to one or more of the apparatuses 110 via lighting network 100. In some embodiments, network controller 120 is equipped with a dedicated button or switch which, when activated, causes network controller 120 to send out one or more identification commands for instructing each apparatus 110 to each indicate its network address, as described below.

Figure 2:
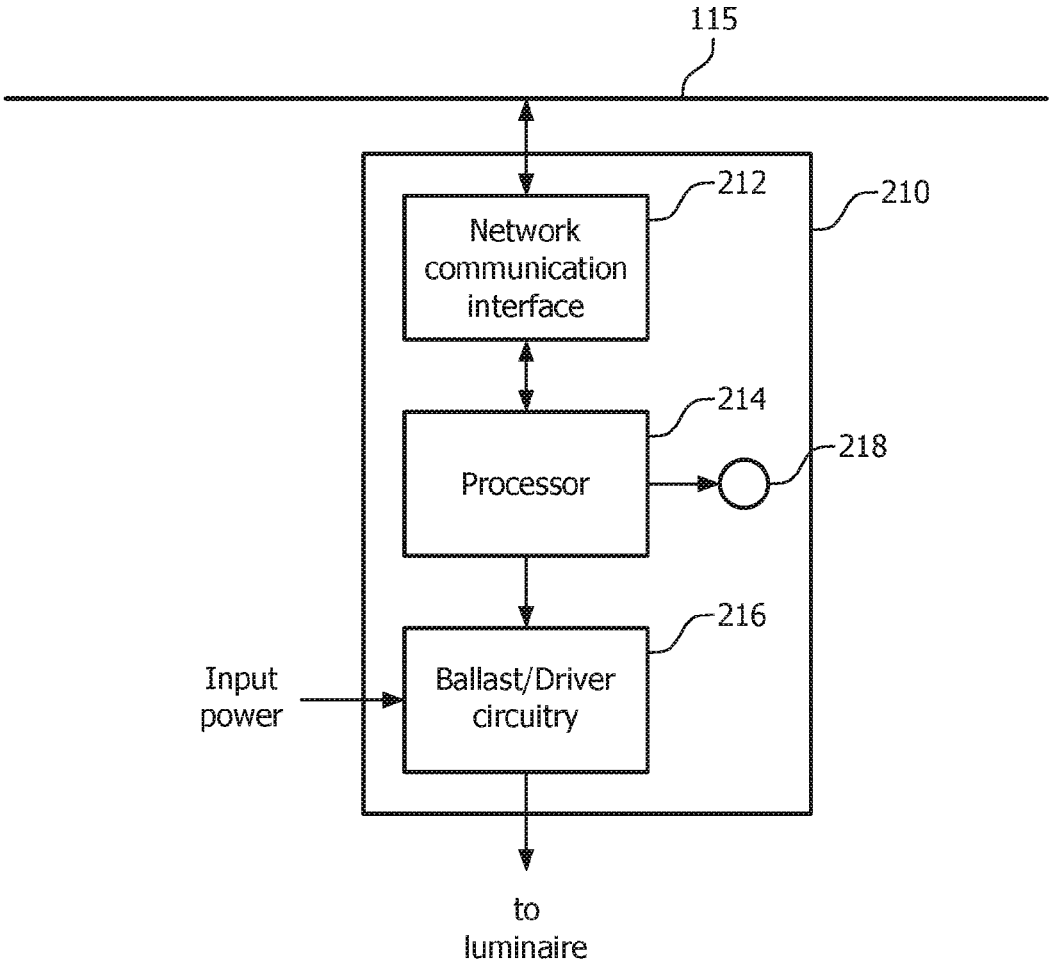
FIG. 2 is a functional block diagram of one example embodiment of a network apparatus for a lighting network.

FIG. 2 is a functional block diagram of one example embodiment of a network apparatus 210 for a lighting network such as lighting network 100. Network apparatus 210 may be one embodiment of apparatus 110 of FIG. 1. Network apparatus 210 includes network communication interface circuit 212, a processor 214, ballast and/or driver circuitry 216, and a signaling device 218.

Communication interface circuit 212 is configured to interface to a network connection 115 to thereby communicate commands and data between processor 214 and one or more other devices of lighting network 100, for example network controller 120 (e.g., a DALI controller). In some embodiments, communication interface circuit 212 may comprise a DALI interface. In some embodiments where network connections 215 comprise wireless connections, communication interface circuit 212 may comprise wireless communication circuitry.

Processor 214 may include or have associated therewith memory, including for example non-volatile memory and/or volatile memory. Such memory may store data and/or instructions (executable software) for executing one or more algorithms, including algorithms for communicating a network address of network apparatus 210 as described herein.

Ballast or driver circuitry 216 may comprise electrical circuitry which is configured to receive input power, for example AC power from AC mains or DC power from a battery back-up, to convert the received power into an appropriate format for driving each associated lighting unit 10, and to supply the properly converted power to each associated lighting unit 10 in response to at least one control signal supplied by processor 214.

Beneficially, signaling device 218 is integral to network apparatus 210, for example mounted on a circuit board or a housing of network apparatus 210.

In one embodiment, signaling device 218 is a lighting device which is configured to be externally visible to a use or installer of network apparatus 210. In that case, the illumination state of signaling device 218 may be controlled, in whole or in part, by processor 214. For example, as explained in greater detail below with respect to FIGS. 3-5, processor 214 may control signaling device 218 to be illuminated to indicate a time interval when a bit of the network address of apparatus 210 is being validly communicated or indicated by one or more lighting units 10 under control of apparatus 210. In one embodiment, signaling device 218 may comprise an LED, for example a colored LED such as a red or green LED.

In another embodiment, signaling device 218 is a sound emitting device such as a buzzer or a piezoelectric transducer.

In operation, network communication interface circuit 212 is configured to receive commands (e.g., DALI commands) via lighting network 100 (e.g., a DALI network) and to provide these commands to processor 214. In response to these commands, processor 214 provides one or more controls signal to ballast and/or driver circuitry 216 to control the supply of power from ballast and/or driver circuitry 216 to one or more lighting units 10 connected to network apparatus 210.

Embodiments will now be described of methods for an apparatus 110 (for example, network apparatus 210 which may comprise a ballast or a lighting driver), to identify itself and communicate its network address to an engineer, installer, or user of lighting network 100, for example during a process of commissioning a lighting network. In the description to follow, in order to provide a more concrete illustration additional details are provided regarding a particular embodiment where lighting network 100 is a DALI network. However, it should be understood that in general the method may be employed by other types of lighting networks.

When a commissioning engineer, installer, or an end user sends a broadcast DALI command 240 "START IDENTIFICATION" then each apparatus 110 connected to the lighting network 100 will indicate its 8-bit short address sequentially (e.g., MSB to LSB, or LSB to MSB) by causing the lighting unit(s) 10 which it controls for each bit of the short address to enter an illumination state which corresponds to and identifies the value of that bit. For example, in some embodiments a first value for a bit may be indicated by turning the lighting unit(s) 10 ON, and a second value for the bit may be indicated by turning the lighting unit(s) 10 OFF. Instead of turning the lighting unit(s) 10 which it controls ON or OFF to indicate the value of a bit, in other embodiments apparatus 110 may cause these lighting unit(s) 10 to have a higher brightness level to indicate the first value, and a lower, dimmed, brightness level to indicate the second bit value. In still other embodiments, apparatus 110 may cause the lighting unit(s) 10 which it controls to blink to indicate the first value, and to remain at a constant brightness level (which may be ON or OFF) to indicate the second bit value. In each of these embodiments, in some implementations the first value may be a "1" and the second value may be a "0," while in other implementations the first value may be a "0" and the second value may be a "1." Beneficially, a manufacturer of an apparatus 110 may indicate to the engineer, installer, or end user what illumination state signifies a binary "1" and what illumination state signifies a binary "0" by means of a label on apparatus 110 or a user manual or other documentation associated with apparatus 110.

A signaling device integral to apparatus 110, such as an LED indicator or other lighting device, a sound emitting device such as buzzer, etc. will indicate when the data indicated by the illumination state of lighting unit(s) 10 is valid for a given bit, so that the engineer, installer, or end user can note the illumination state of lighting unit(s) 10 at that time. In particular, where the signaling device is an LED, the LED may turn ON or flash multiple times (i.e., blink) for a brief time interval during the bit period for each bit whose value is signaled by the illumination state of lighting unit(s) 10 to indicate the appropriate time for the engineer, installer or end user to note the illumination state of lighting unit(s) 10, and therefore determine the value of that bit of the network address. Beneficially, the signaling device is activated for a time interval in a central portion of the bit period employed by apparatus 110 to communicate its network address, and the time interval is long enough for an engineer, installer, or end user to recognize the signal and note the current illumination state of lighting unit(s) 10 indicating the value of the current bit which is being communicated for the network address.

Figure 3:
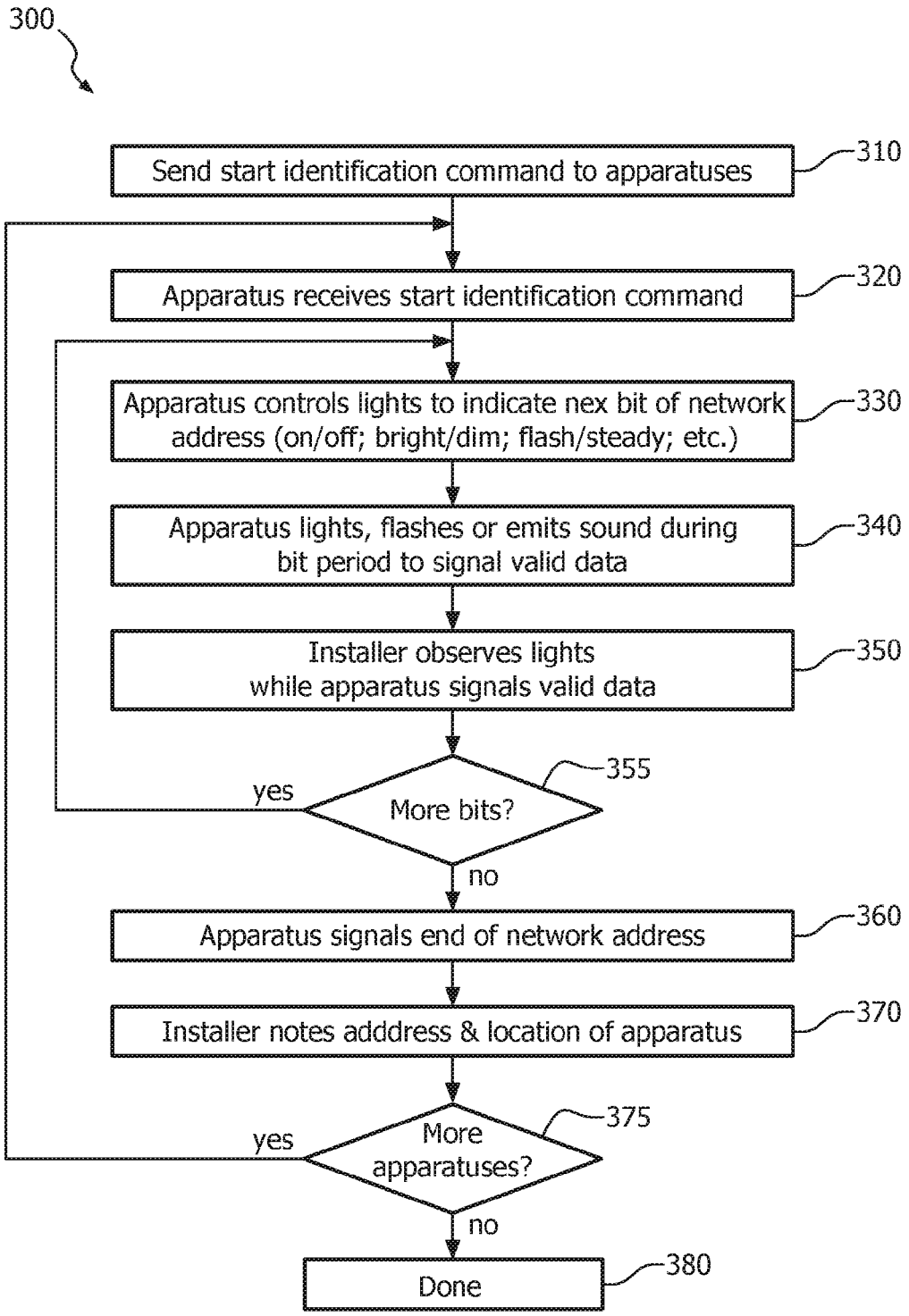
FIG. 3 is a flowchart of one embodiment of a process for commissioning a lighting network, wherein a network apparatus, such as a lighting ballast or driver, which is connected in the lighting network, identifies itself and communicates its network address.

More specifically, FIG. 3 is a flowchart of one embodiment of a process 300 for commissioning a lighting network such as lighting network 100, wherein a network apparatus, such as apparatus 110 or network apparatus 210, which is connected in lighting network 100, identifies itself and communicates its network address.

In a step 310, a commissioning engineer, installer, or end user, for example, sends a start identification command (e.g., a DALI "START IDENTIFICATION" command) to all apparatuses 110 (for example, network apparatus 210 which may comprise a ballast or a lighting driver) of lighting network 100, and tells the software or commissioning tool to repeat this command until it is stopped. In one embodiment, the engineer, installer, or end user may perform step 310 by connecting a computer to a network controller 120, for example via an interface or connector (e.g., a USB connector) on network controller 120. In another embodiment, network controller 120 may be equipped with a dedicated button or switch which is activated by the engineer, installer, or end user to causes network controller 120 to repeatedly send out identification commands until the switch or button is deactivated.

In a step 320, a first apparatus 110, for example network apparatus 210 (which may comprise a ballast or a lighting driver) receives the start identification command. For example, processor 214 may receive the start identification command from a lighting network connection 115 via network communication circuit 212.

In a step 330, apparatus 110 controls those lighting unit(s) 10 which it drives to enter a particular illumination state for a certain period of time, referred to here as a bit period, where the particular illumination state corresponds to and identifies the value of the first bit of the network address (which can be the LSB or MSB in different embodiments). Beneficially, the bit period has a fixed length, T, which is long enough for an engineer, installer, or user to observe and recognize changes in the illumination states of lighting unit(s) 10 from one bit period to the next. In some embodiments, T may have a value from one half second to three second. In some embodiments, T may have a value of about one second (i.e., one second ±10%).

For example, as explained above, in different embodiments: an illumination state of being ON may indicate a first value (e.g., "1") for the bit, while an illumination state of being OFF may indicate a second value (e.g., "0") for the bit (or vice versa); an illumination state having a greater intensity or brightness may indicate a first value (e.g., "1") for the bit, while an illumination state having a lower intensity or brightness may indicate a second value (e.g., "0") for the bit (or vice versa); an illumination state of blinking or flashing may indicate a first value (e.g., "1") for the bit, while an illumination state having a constant intensity or brightness (either ON or OFF) may indicate a second value (e.g., "0") for the bit (or vice versa); an illumination state producing light having a first color may indicate a first value (e.g., "1") for the bit, while an illumination state having a second color may indicate a second value (e.g., "0") for the bit; etc.

In a particular embodiment, in step 330 processor 214 provides one or more control signals to ballast or driver circuitry 216 for controlling the illumination of lighting unit(s) 10 to cause lighting unit(s) to enter the desired illumination state which corresponds to the value of the current bit of the network address.

In a step 340, a signaling device of apparatus 110 (e.g., signaling device 218 of apparatus 210) signals during a time interval within the bit period that the illumination state of lighting unit(s) 10 validly indicates the value of the bit. That is, signaling device 218 signals or indicates to the engineer, installer, or end user that a new bit is being indicated by the present illumination state of lighting unit(s) 10. For example, consider a case where a bit value of "1" is indicated by turning lighting unit(s) ON during a corresponding bit period, and where the network address includes a series of consecutive "1"s (e.g., "00111110"). In that case, it may be difficult or impossible for the engineer, installer, or user to identify the number of consecutive "1"s in the network address simply by observing the illumination state of lighting unit(s) 10. However, signaling device 218 will provide a separate signal during each bit period so that the engineer, installer, or user is able to thereby identify win one bit period has transitioned to the next. For an 8-bit address, signaling device 218 will provide eight signals. And in the example above where the 8-bit address has five consecutive "1"s then signaling device 218 would provide a total of five signals while lighting unit(s) 10 are ON, so that the engineer, installer, or user can easily identify that there are five consecutive "1"s in the network address.

As noted above, beneficially signaling device 218 is activated for a time interval in a central portion of the bit period, and this time interval is long enough for an engineer, installer, or end user to recognize the signal and note the current illumination state of lighting unit(s) 10 corresponding to the value of the current bit which is being communicated. Also as noted above, in different embodiments signaling device 218 may provide a visual or an audible signal, for example an LED may be turned ON briefly, or it may blink or flash, or it may emit a tone or buzzing sound, etc.

In a particular embodiment, in step 340 processor 214 controls or otherwise causes signaling device 218 to signal during a time interval within the bit period that the illumination state of the lighting unit(s) 10 validly indicates the value of the current bit, as described above.

In a step 350, the engineer, installer, or user observes the illumination state of lighting unit(s) 10 at the time when signaling device 218 signals that the next bit of the network address is now validly being indicated by lighting unit(s) 10. The engineer, installer, or user may then write down the current bit value (e.g., a "1") on a piece of paper or enter it in a computer, tablet, portable data entry device, etc.

In a step 355, apparatus 110 (e.g., a processor of apparatus 110) determines whether there are more bits of the network address remaining to be communicated or indicated by lighting unit(s) 110. If so, then the process returns to step 330, and then steps 330-350 are repeated for the next bit of the network address of apparatus 110. On the other hand, if the previous bit was the last bit of the network address (e.g., MSB or LSB), and there are no more bits of the network address remaining to be communicated or indicated by lighting unit(s) 110, then the process proceeds to step 360.

In a step 360, apparatus 110 signals the end of the network address. In various embodiments, apparatus 110 may signal the end of the network address by any of the following methods: activating signaling device 218 for a prolonged time (e.g., turning an LED indicator ON or OFF for a prolonged time; intermittently activating signaling device 218 several times (e.g., flashing an LED indicator several times); turning lighting unit(s) 10 ON or OFF for a prolonged time; etc. The prolonged time may be several seconds. Other methods of indicating the end of the network address are possible. In a particular embodiment, processor 214 of apparatus 200 may control apparatus 200 and/or lighting unit(s) 10 to signal the end of the network address.

In a step 370, the engineer, installer or end user notes on a map or floor plan of the facility the location of apparatus 110 and its network address. Again, this may be done on paper or electronically on a computer, tablet, or other portable data entry device.

In a step 375, the engineer, installer or end user determines whether or not the locations and network addresses of all network apparatuses 110 of lighting network 100 have been determined. If not, then the process returns to step 320, and then steps 320 through 370 are repeated for the next apparatus 110. On the other hand, if the engineer, installer or end user has determined the locations and network addresses of all network apparatuses 110 of lighting network 100, then in step 380 the process ends.

In a particular embodiment where apparatus 110 corresponds to apparatus 200 of FIG. 2, processor 214 may execute an algorithm under software control to perform steps 320, 330, 340, 355, and 360 of the process 300. Furthermore, processor 214 may repeatedly execute these steps so long as network controller 120 continues to transmit or broadcast the start identification command on lighting network 100.

Figure 4:
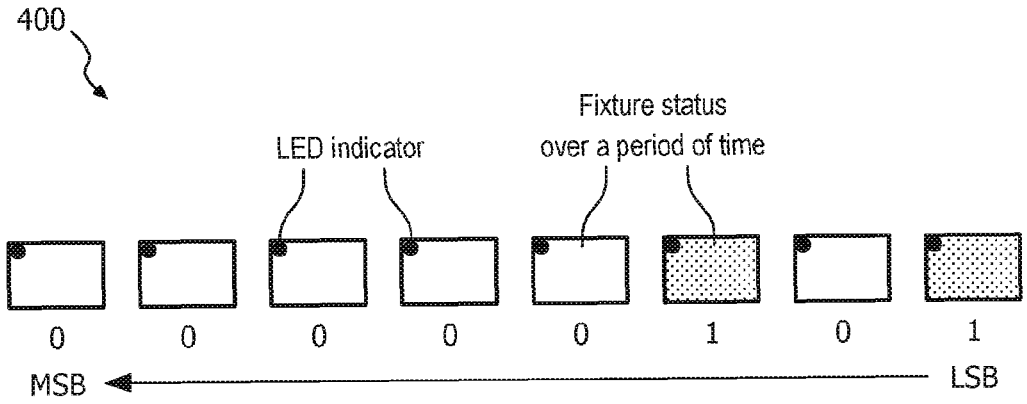
FIG. 4 illustrates one possible scenario of a network apparatus, which may comprise a ballast or lighting driver, identifying itself and communicating its network address.

FIG. 4 illustrates one possible scenario of a DALI apparatus having a short address of five (5) identifying itself and communicating or indicating its network address as a sequence of binary bits "00000101" as described above with respect to FIG. 3, where the LSB is indicated first and the MSB is indicated last. In this example, for simplification of the explanation it is assumed that the signaling device (e.g., signaling device 218) is an LED indicator, but it will be understood that other signaling devices may be used instead.

In this scenario, when the identification process described above with respect to FIG. 3 is executed, the LSB is 1 and therefore to indicate binary "1" apparatus 110 may: (1) turn lighting unit(s) 10 ON (if they were OFF) or will keep lighting unit(s) 10 ON (if they were already ON) or vice versa; or (2) set lighting unit(s) 10 to a bright level (if they were low) or will keep lighting unit(s) 10 at a bright level (if they were already bright); etc. Then apparatus 110 will cause the LED indicator to turn ON or OFF, or to flash or blink once or multiple times thereby prompting the engineer or the end user to note the status of lighting unit(s) 10.

At this time, the engineer, installer or end user will note the status of lighting unit(s) 10 and will mark a binary "1" on a piece of paper or a data entry device as the LSB bit or the first bit of the 8 bit binary network address.

In this example, as shown in FIG. 4, the next bit to be transmitted is a binary "0" and therefore to indicate this bit apparatus 110 may: (a) turn lighting unit(s) 10 OFF (if they were ON) or keep lighting unit(s) 10 OFF (if they were already OFF) or vice versa; (b) dim lighting unit(s) 10 low (if they were bright) or keep lighting unit(s) 10 low (if they were already low).

Then apparatus 110 will once again cause the LED indicator to turn ON or OFF, or to flash or blink once or multiple times thereby prompting the engineer or the end user to note the status of lighting unit(s) 10 again.

Then, the engineer, installer or end user will note the status of lighting unit(s) 10 and will mark a binary "0" on a piece of paper or a data entry device as the next bit of the 8 bit binary network address.

This process will repeat for indicating the remaining bits of the network address.

When the last bit of the network address has been indicated, apparatus 110 will indicate the end of the network address (i.e., the last bit of the network address has just been indicated), for example by: (1) keeping the LED indicator ON or OFF for a prolonged time; (2) flashing or blinking the LED indicator multiple times; or (3) keeping the electric lights ON or OFF for a prolonged time. Other means of indicating the end of the network address may be employed.

By the end of the process the engineer, installer or end user will have noted the following binary code "00000101." He or she may then feed this binary code into a binary to decimal converter (e.g., the WINDOWS® calculator available on all MS WINDOWS® PCs) and will get an equivalent decimal value of "5."

For example, the engineer, installer, or end user may walk the entire floor of a site or facility and stand underneath each luminaire and can note the address of each apparatus on the corresponding floor plan or map. Such a detailed floor plan can prove handy for future maintenance of the site, to monitor any commissioning changes on the lighting system and may save time and labor costs.

It is noted that in a DALI network, the DALI short address is limited to 5 bits (not all 8 bits of a binary byte) and therefore an apparatus may be designed to only indicate the required 5 bits of the short address rather than indicating all 8 bits.

Figure 5:
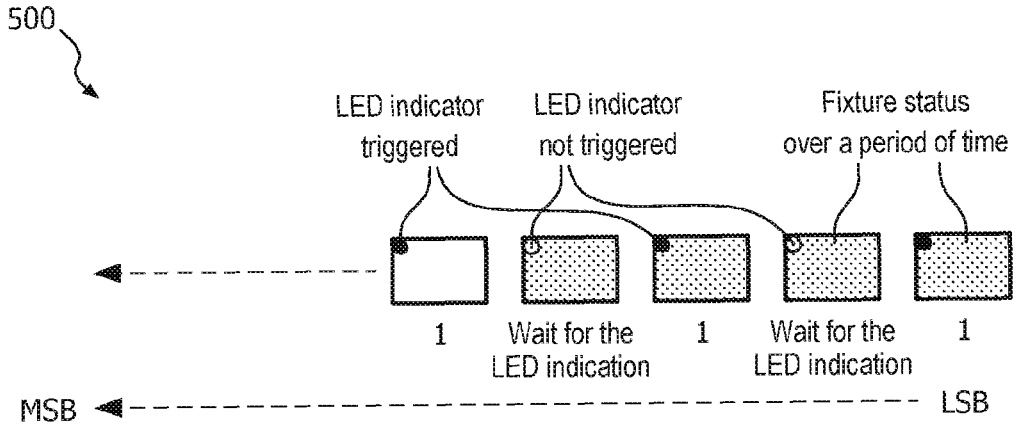
FIG. 5 illustrates another possible scenario in one embodiment of a method of an a network apparatus, which may comprise a ballast or lighting driver, identifying itself and communicating or indicating its network address.

FIG. 5 illustrates another possible scenario in one embodiment of a method of an apparatus, which may comprise a ballast or lighting driver, identifying itself and communicating or indicating its network address. In this scenario, lighting unit(s) 10 associated with an apparatus 110 are continuously illuminated to indicate a consecutive series of "1"s or "0"s, and the signaling device (e.g., an LED indicator) is used to indicate when the engineer, installer or end user should record the value of a current bit.

The method as described above with respect to FIGS. 3-5 employs lighting unit(s) 10 to communicate data corresponding to a network address of an apparatus, and employs signaling device 218 to indicate a time interval during which the illumination state of lighting unit(s) 10 indicates valid data. Such an arrangement is particularly advantageous because it allows an engineer, installer or user to easy correlate particular lighting unit(s) 10 with the particular apparatus 110 which controls them.

However, in an alternative embodiment the roles of the lighting unit (s) 10 and signaling device 218 may be reversed. That is, in an alternative embodiment, a method employs signaling device 218 to communicate data corresponding to a network address of an apparatus, and employs lighting unit(s) 10 to indicate a time interval during which the state of signaling device 218 indicates valid data.

Figure 6:
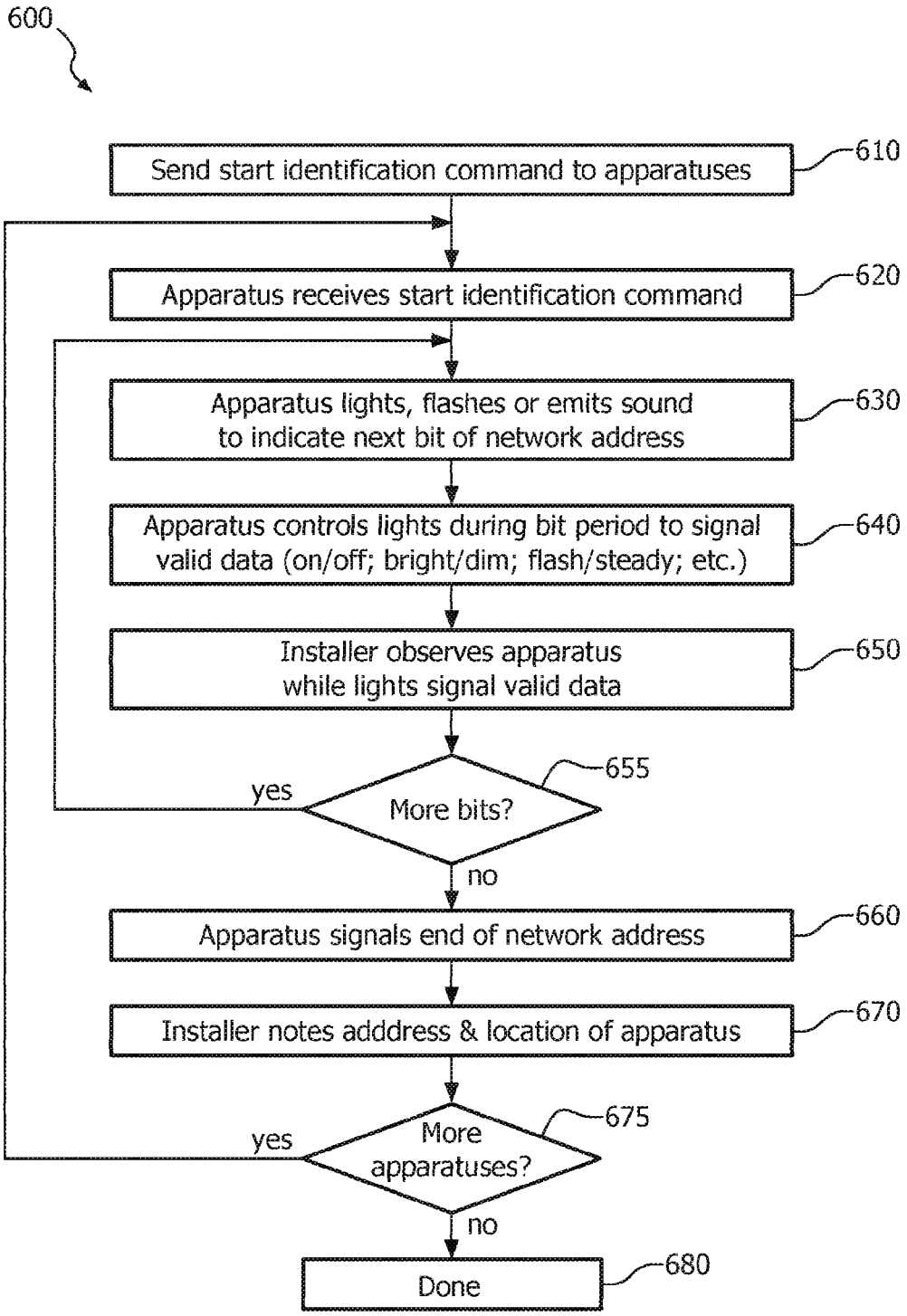
FIG. 6 is a flowchart of another embodiment of a process for commissioning a lighting network, wherein a network apparatus, such as a lighting ballast or driver, which is connected in the lighting network, identifies itself and communicates its network address.

More specifically, FIG. 6 is a flowchart of another embodiment of a process 600 for commissioning a lighting network such as lighting network 100, wherein a network apparatus, such as apparatus 110 or network apparatus 210, which is connected in lighting network 100, identifies itself and communicates its network address.

In a step 610, a commissioning engineer, installer, or end user, for example, sends a start identification command (e.g., a DALI "START IDENTIFICATION" command) to all apparatuses 110 (for example, network apparatus 210 which may comprise a ballast or a lighting driver) of lighting network 100, and tells the software or commissioning tool to repeat this command until it is stopped. In one embodiment, the engineer, installer, or end user may perform step 610 by connecting a computer to a network controller 120, for example via an interface or connector (e.g., a USB connector) on network controller 120. In another embodiment, network controller 120 may be equipped with a dedicated button or switch which is activated by the engineer, installer, or end user to causes network controller 120 to repeatedly send out identification commands until the switch or button is deactivated.

In a step 620, a first apparatus 110, for example network apparatus 210 (which may comprise a ballast or a lighting driver) receives the start identification command. For example, processor 214 may receive the start identification command from a lighting network connection 115 via network communication circuit 212.

In a step 630, apparatus 110 controls a signaling device of apparatus 110 (e.g., signaling device 218 of apparatus 210) to provide a signal for a certain period of time, referred to here as a bit period, where the particular signal corresponds to and identifies the value of the first bit of the network address (which can be the LSB or MSB in different embodiments). Beneficially, the bit period has a fixed length, T, which is long enough for an engineer, installer, or user to observe and recognize changes in signal supplied by signaling device 218 from one bit period to the next. In some embodiments, T may have a value from one half second to three second. In some embodiments, T may have a value of about one second (i.e., one second ±10%).

In different embodiments, signaling device 218 may provide a visual or an audible signal. For example, signaling device may be turned ON or illuminated to indicate a first value (e.g., "1") for the bit, while signaling device may be turned OFF to indicate a second value (e.g., "0") for the bit (or vice versa); an illumination state of blinking or flashing may indicate a first value (e.g., "1") for the bit, while an illumination state having a constant intensity or brightness (either ON or OFF) may indicate a second value (e.g., "0") for the bit (or vice versa); an illumination state producing light having a first color may indicate a first value (e.g., "1") for the bit, while an illumination state having a second color may indicate a second value (e.g., "0") for the bit; emitting a certain sound or tone may indicate a first value (e.g., "1") for the bit, while emitting a different sound or tone may indicate a second value (e.g., "0") for the bit; etc.

In a particular embodiment, in step 630 processor 214 provides one or more control signals to signaling device 218 for controlling signaling device to cause it to provide the desired signal which corresponds to and indicates the value of the current bit of the network address.

In a step 640, one or more lighting unit(s) 10 which are controlled by apparatus 110 are controlled to indicate during a time interval within the bit period that the state of signaling device 218 validly indicates the value of the bit. That is, lighting unit(s) 10 signal or indicates to the engineer, installer, or end user that a new bit is being indicated by the present signal which is being provided by signaling device 218. For example, consider a case where a bit value of "1" is indicated by turning signaling device 218 ON during a corresponding bit period, and where the network address includes a series of consecutive "1"s (e.g., "00111110"). In that case, it may be difficult or impossible for the engineer, installer, or user to identify the number of consecutive "1"s in the network address simply by observing the state of signaling device 218. However, lighting unit(s) 10 will provide a separate signal during each bit period so that the engineer, installer, or user is able to thereby identify win one bit period has transitioned to the next. For an 8-bit address, lighting unit(s) 10 will provide eight indications of valid data, one for each bit. And in the example above where the 8-bit address has five consecutive "1"s then lighting device (s) 10 would provide a total of five indications of valid data while signaling device 218 remains turned ON, so that the engineer, installer, or user can easily identify that there are five consecutive "1"s in the network address.

Beneficially lighting unit(s) 10 are controlled to indicate valid data for a time interval in a central portion of the bit period, and this tie interval is long enough for an engineer, installer, or end user to recognize the indication of valid data and to note the current state of signaling device 218 corresponding to the value of the current bit which is being communicated. In different embodiments lighting unit(s) may indicate a time interval for observing a valid signal from signaling device 218 by, for example, turning ON briefly, turning OFF briefly, flashing briefly, ceasing to flash briefly, etc.

In a particular embodiment, in step 640 processor 214 controls or otherwise causes lighting unit(s) 10 to indicate during a time interval within the bit period that signaling device 218 is currently indicating the value of the current bit, as described above.

In a step 650, the engineer, installer, or user observes the state of signaling device 218 at the time when lighting unit(s) 610 are indicating that the next bit of the network address is now validly being communicated by signaling device 218. The engineer, installer, or user may then write down the current bit value (e.g., a "1") on a piece of paper or enter it in a computer, tablet, portable data entry device, etc.

In a step 655, apparatus 110 (e.g., a processor of apparatus 110) determines whether there are more bits of the network address remaining to be communicated or indicated by lighting unit(s) 110. If so, then the process returns to step 630, and then steps 630-650 are repeated for the next bit of the network address of apparatus 110. On the other hand, if the previous bit was the last bit of the network address (e.g., MSB or LSB), and there are no more bits of the network address remaining to be communicated or indicated by signaling device 218, then the process proceeds to step 660.

In a step 660, apparatus 110 signals the end of the network address. In various embodiments, apparatus 110 may signal the end of the network address by any of the following methods: activating signaling device 218 for a prolonged time (e.g., turning an LED indicator ON or OFF for a prolonged time; intermittently activating signaling device 218 several times (e.g., flashing an LED indicator several times); turning lighting unit(s) 10 ON or OFF for a prolonged time; etc. The prolonged time may be several seconds. Other methods of indicating the end of the network address are possible. In a particular embodiment, processor 214 of apparatus 200 may control apparatus 200 and/or lighting unit(s) 10 to indicate the end of the network address.

In a step 670, the engineer, installer or end user notes on a map or floor plan of the facility the location of apparatus 110 and its network address. Again, this may be done on paper or electronically on a computer, tablet, or other portable data entry device.

In a step 675, the engineer, installer or end user determines whether or not the locations and network addresses of all network apparatuses 110 of lighting network 100 have been determined. If not, then the process returns to step 620, and then steps 620 through 670 are repeated for the next apparatus 110. On the other hand, if the engineer, installer or end user has determined the locations and network addresses of all network apparatuses 110 of lighting network 100, then in step 680 the process ends.

In a particular embodiment where apparatus 110 corresponds to apparatus 200 of FIG. 2, processor 214 may execute an algorithm under software control to perform steps 620, 630, 640, 655, and 660 of the process 600. Furthermore, processor 214 may repeatedly execute these steps so long as network controller 120 continues to transmit or broadcast the start identification command on lighting network 100.

Figure 7:
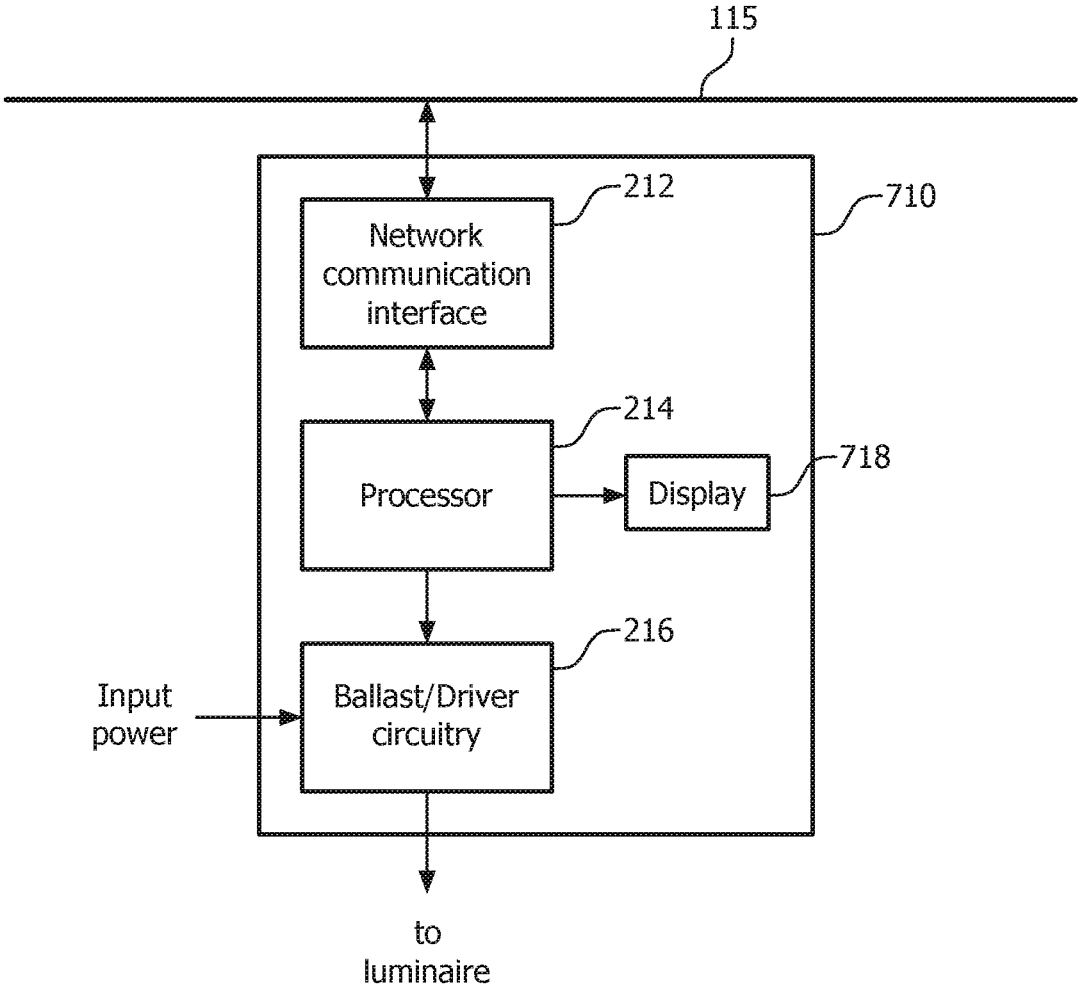
FIG. 7 is a functional block diagram of another example embodiment of a network apparatus for a lighting network.

FIG. 7 is a functional block diagram of another example embodiment of a network apparatus 710 for a lighting network such as lighting network 100. Network apparatus 710 may be one embodiment of apparatus 110 of FIG. 1. Network apparatus 710 includes network communication interface circuit 212, processor 214, ballast and/or driver circuitry 216, and a display device 718.

Beneficially, display device 718 is integral to network apparatus 710, for example mounted on a circuit board or a housing of network apparatus 710. Beneficially, display device 718 is configured to be externally visible to a user or installer of network apparatus 710. Display device 718 is a device capable of displaying a network address of apparatus 710. For example, display device 718 may comprise a liquid crystal display (LCD) device, a light emitting device (LED) display device, an organic LED display device, a set of 7-segment LED devices, etc.

In operation, network communication interface circuit 212 is configured to receive commands (e.g., DALI commands) via lighting network 100 (e.g., a DALI network) and to provide these commands to processor 214. In response to these commands, processor 214 provides one or more controls signal to ballast and/or driver circuitry 216 to control the supply of power from ballast and/or driver circuitry 216 to one or more lighting units 10 connected to network apparatus 710.

Beneficially, processor 214 causes display device 718 to display a network address (e.g., a DALI short address) that has been assigned to apparatus 710.

In one embodiment, display device may continuously display the network address. In another embodiment, processor 214 is configured to cause display device 718 to display the network address assigned to apparatus 710 in response to an identification command received from lighting network 100 via communication interface circuit 212.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited. Also, reference numerals appearing in the claims in parentheses, if any, are provided merely for convenience and should not be construed as limiting the claims in any way.

The invention claimed is:

1. An apparatus configured to be connected to a Digital Addressable Lighting Interface network, the apparatus comprising:

a processor;

a display device integral to the apparatus; and a network communication interface circuit configured to receive DALI commands via the DALI network and to provide the DALI commands to the processor, the processor configured to receive an identification DALI command via DALI network, and in response thereto to causes the display device to display a DALI short address assigned to the apparatus.

2. The apparatus of claim 1, further comprising an electrical circuit configured to supply power to at least one lighting unit in response to at least one control signal supplied by the processor.

3. A lighting unit further comprising the apparatus of claim 1.

4. A lighting system comprising a plurality of lighting units as claimed in claim 3 connected to the Digital Addressable Lighting Interface network, wherein each of the processors of the plurality of lighting units, each comprising the apparatus, receive the identification DALI command and in response thereto cause each of the display device to display the DALI short address assigned to each of the apparatus, respectively.

5. The lighting system of claim 4, wherein each of the DALI short addresses for each of the plurality of the apparatus are different.

6. An apparatus configured to be connected to a lighting network and to control a first and a second lighting unit in response to at least one signal received via the lighting network, the apparatus comprising:

a processor configured to receive an identification command, and in response thereto to execute an algorithm for communicating a network address associated with the apparatus, the algorithm comprising sequentially, for each bit of the network address:

controlling the first lighting unit, to indicate a value of the bit by the lighting unit entering a state corresponding to the value of the bit, and causing the second lighting unit, to signal that the first lighting unit validly indicates the value of the bit; and after the values for all of the bits of the network address have been indicated by the first lighting unit, causing the second lighting unit to enter a state which indicates an end of the network address.

7. The apparatus of claim 6, wherein the first lighting unit is at least one lighting unit and the second lighting unit is a signaling device.

8. The apparatus of claim 6, wherein the first lighting unit is a signaling device and the second lighting unit is an at least one lighting unit.

9. A lighting apparatus configured to be connected to the lighting network, the apparatus comprising the first lighting unit, the second lighting unit, and the apparatus of claim 7.

10. The apparatus of claim 6, wherein the processor is configured to cause the first lighting unit to indicate the value of the bit during a bit period, and the processor is configured to cause the second lighting unit, to signal that the first lighting unit validly indicates the value of the bit during a time interval within the bit period.

11. The apparatus of claim 10, further comprising an electrical circuit configured to supply power to the apparatus in response to at least one control signal supplied by the processor.

12. The apparatus of claim 11, wherein the processor is configured to generate the at least one control signal in response to a command received via the lighting network.

13. The apparatus of claim 10, further comprising a network communication interface circuit configured to communicate the identification command from the network to the processor.

14. The apparatus of claim 10, wherein the first lighting unit indicates that the value of the bit is a first value by being illuminated during the bit period, and indicates that the value of bit is a second value by not being illuminated during the bit period.

15. The apparatus of claim 10, wherein the first lighting unit indicates that the value of the bit is a first value by being illuminated at a higher intensity during the bit period, and indicates that the value of bit is a second value by being illuminated at a lower intensity during the bit period.

16. The apparatus of claim 10, wherein the first lighting unit indicates that the value of the bit is a first value by blinking during the bit period, and indicates that the value of bit is a second value by not blinking during the bit period.

17. The apparatus of claim 10, wherein the second lighting unit is a signaling device, and wherein the signal device signals by becoming illuminated during the time interval that the illumination state of the first lighting unit validly indicates the bit value.

18. The apparatus of claim 10, wherein the second lighting unit is a signaling device, and wherein the lighting device signals by blinking during the time interval that the illumination state of the first lighting unit validly indicates the bit value.

* * * * *